United States Patent [19]

Ebihara et al.

[11] 4,142,362

[45] Mar. 6, 1979

[54] DIGITAL DISPLAY TIMEPIECE

[75] Inventors: Heihachiro Ebihara; Fukuo Sekiya, both of Tokorozawa; Takashi Yamada, Sayama, all of Japan

[73] Assignee: Citizen Watch Co. Ltd., Tokyo, Japan

[21] Appl. No.: 781,329

[22] Filed: Mar. 25, 1977

[30] Foreign Application Priority Data

Mar. 26, 1976 [JP] Japan ..... 51-36560[U]
Mar. 29, 1976 [JP] Japan ..... 51-38152[U]

[51] Int. Cl.[2] ..... G04B 19/32

[52] U.S. Cl. ..... 58/50 R; 58/4 A; 58/85.5

[58] Field of Search ..... 58/4 A, 23 R, 39.5, 58/50 R, 58, 85.5

[56] References Cited

U.S. PATENT DOCUMENTS 3,961,472 6/1976 Riehl ..... 58/4 A
3,992,871 11/1976 Numabe ..... 58/39.5

*Primary Examiner*—Robert K. Schaefer
*Assistant Examiner*—Vit W. Miska
*Attorney, Agent, or Firm*—Sherman & Shalloway

[57] ABSTRACT

A digital display timepiece being provided with electro-optical display devices in which when clock information corrected partition marks provided near respective units in a clock information indicator are adapted to flash whereby the numerical figure to be corrected in a display portion can be easily confirmed.

17 Claims, 10 Drawing Figures

DIGITAL DISPLAY TIMEPIECE

BACKGROUND OF THE INVENTION

1. Field of the Invention

This invention relates to correction of the clock information in a digit display timepiece and, more particularly, to the display in a digit display timepiece wherein the numerical figure to be corrected in a display portion can be easily confirmed.

2. Description of the Prior Art

Heretofore, display of the clock information in a digit display timepiece has been carried out in a manner that the information figures to be corrected in a display portion are flashed and correction is made according to said flashed condition. Therefore, it has been difficult to confirm the numerical figures to be corrected. In addition, a calendar display in a prior art digit display timepiece has been made by only arraying the numerical figures standing for "year," "month" and "date" in a row in order to discriminate them from time information display. Therefore, it has been hard to figure out "year," "month" and "date" at a glance.

More specifically, the clock information in a prior art digit display timepiece has been displayed as shown in FIGS. 1A to 1C. Particularly, in FIG. 1A there are shown hour, minute and second informations, that is, 12 hours 34 minutes 56 seconds are displayed with time displaying marks such as "colon" and "dash." In this drawing, reference numeral 1 denotes a body of the digit display timepiece, 2 a digit indicator, 3 a changing switch, and 4, 5 assemblies comprising minutes figure displaying segments.

FIG. 1B shows a digit indicator 2 in which calendar information, that is, year, month and date informations are shown by operating said changing switch 3. As seen from FIG. 1B, numerical figures are only arrayed in a row, in which Mar. 3, 76 (1976) are displayed.

In FIG. 1C, there are also shown year, month and date as calendar information, in which the "year" display portion 6 consists of a smaller digit indicator than that in FIG. 1B. Therefore, the calendar information in FIG. 1C is legible more than that in FIG. 1B.

However, in the case where any of the time information such as hour, minute and second or the calendar information such as year, month and date displayed in the above-described prior art digit indicator 2 is corrected, correction of the display has been carried out while flashing the selected assembly comprising figure display segments. Therefore, it has been difficult to confirm the numerical figure to be corrected. Particularly, the year, month and date in the calendar display portion have been displayed by only arraying numerical figures in a row, so that it has been very difficult to confirm the unit or numerical figure to be corrected since the display unit in a display portion to be corrected is flashing.

SUMMARY OF THE INVENTION

A primary object of the present invention is to provide a digit display timepiece in which the above described disadvantages are obviated.

Another object of the invention is to provide an improved digit display timepiece in which, when there are made corrections in clock information display portion inclusive of calendar display portion, only partition marks are flashed thereby to easily confirm numerical figures to be corrected.

A further object of the invention is to provide an improved digit display timepiece in which calendar information is easily discernible by providing an apostrophe "'" mark in the "year" display portion.

BRIEF DESCRIPTION OF THE DRAWING

FIGS. 1A to 1C are explanatory drawings showing a clock information display portion in a conventional digit display timepiece, respectively, in which FIG. 1A shows a time information display; and FIGS. 1B and 1C show a calendar information display, respectively;

FIGS. 2A to 2C are embodiments of time and calendar information displays in the digit display timepiece according to the present invention, in which FIG. 2A shows a time information display and FIGS. 2B and 2C show a calendar information display, respectively;

FIGS. 3A to 3C are explanatory drawings of another embodiment mainly pertaining to partition marks provided in the calendar information display portion of the digit display timepiece according to the present invention, in which FIG. 3A shows hour, minute, second information display, and FIGS. 3B and 3C show year, month, date information display, respectively.

DETAILED DESCRIPTION OF PREFERRED EMBODIMENTS

Referring now to the accompanying drawings, the details of the embodiments of the present invention will be described in the following.

Figure 2A:
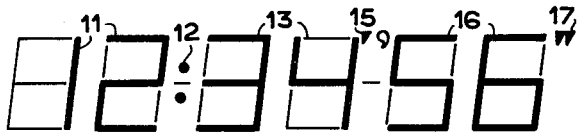
Figure 2B:
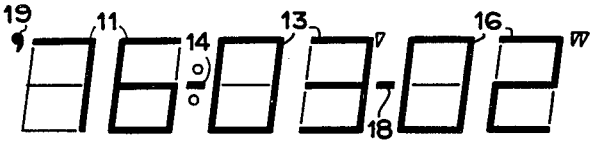
Figure 2C:
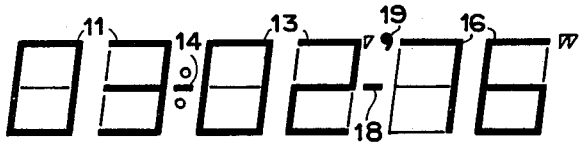

In FIG. 2A is shown an example of time information display in a digit display timepiece according to the present invention, said time information display device comprising a digit indicator 11 as an "hour" display portion, a digit indicator 13 as a "minute" display portion and a digit indicator 16 as a "second" display portion, and a colon indicator 12 and dash indicators 15, 17 as partition marks. When the "hour" display portion is to be corrected, the colon indicator 12 is adapted to flash and when the "minute" or "second" display portion is to be corrected, the dash indicator 15 or 17 is adapted to flash, respectively. FIGS. 2B and 2C show examples of calendar information display. The calendar information display device in FIG. 2B comprises an apostrophe indicator 19 and a digit indicator 11 which constitute a "year" display portion in combination, a digit indicator 13 constituting a "month" display portion and a digit indicator 16 as a "date" display portion. Further, the calendar information display device in FIG. 2C comprises a digit indicator 11 as a "month" display portion, a digit indicator 13 as a "date" display portion and a digit indicator 16 and an apostrophe indicator 19 which constitute a "year" display portion in combination. Further, the calendar information display device shown in FIGS. 2B and 2C comprises hyphen indicators 14, 18 as partition marks for partitioning respective information display portions, in which when the "month" display portion is to be corrected, the hyphen indicator 14 is adapted to flash, and when the "date" display portion is to be corrected the hyphen indicator 18 is adapted to flash, thereby to indicate the display portion to be corrected. Furthermore, according to the present invention, provisions of a hyphen between the "month" and the "date" display portions and a hyphen between the "year" and the "month"

display portions as partition marks make it easy to discern the calendar information display.

Figure 3A:
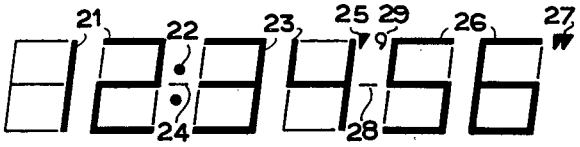
Figure 3B:
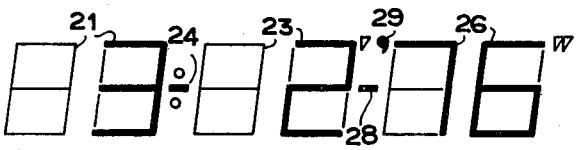
Figure 3C:
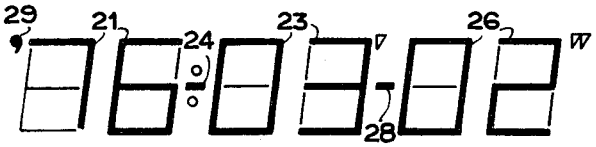
Figure 1A:
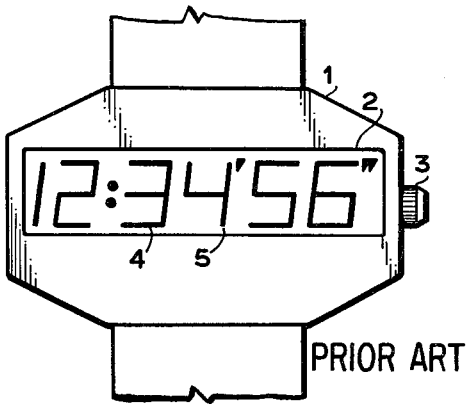
Figure 1B:
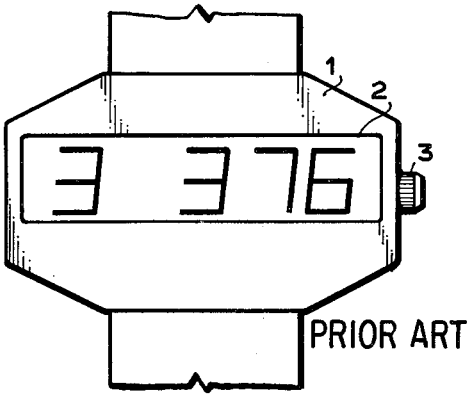
Figure 1C:
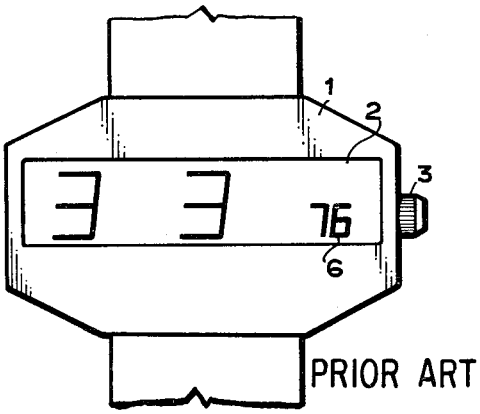

In FIGS. 3A through 3C is shown another embodiment according to the present invention, wherein an apostrophe is provided on a left shoulder portion of the "year" display unit. More specifically, the display device shown in FIG. 3A comprises an "hour" display portion consisting of a digit indicator 21 and a colon indicator 22, a "minute" display portion consisting of a digit indicator 23 and a dash indicator 25 and a "second" display portion consisting of a digit indicator 26 and a dash indicator 27. In addition, there are also provided hyphen indicators 24, 28 and an apostrophe 29 for discriminating the "year" display from the other. That is, FIG. 3A shows an example of a time information display in which 12 hours 34 minutes 56 seconds is indicated as [12:34'56"]. In FIG. 3B is shown an example of a calendar information display in which Mar. 2, 1976 is indicated as [3-2-'76]. More specifically, an apostrophe 29 is provided on the left shoulder of the digit indicator 26 for a "year" display, so that the "year" display is easily discernible. In addition, hyphen indicators 24, 28 are disposed between digit indicators 21 and 23 and between digit indicators 23 and 26, respectively, so that the "month" and "date" can be easily discriminated. In FIG. 3C is shown another embodiment according to the present invention, in which the calendar information display device comprises a digit indicator 21 and an apostrophe indicator 29 which constitute a "year" display portion in combination, a digit indicator 23 as a "month" display portion and a digit indicator 26 as "date" display portion. In FIG. 3C there is shown ['76-03-02] as Mar. 2, 1976. While, in the above, description has been made on the information displays, it is also possible to make use of the apostrophe 29 as a discrimination mark when "year" information is to be corrected. That is, it is easily discriminated by flashing the apostrophe that the correction is being made in the "year" display portion.

Figure 4:
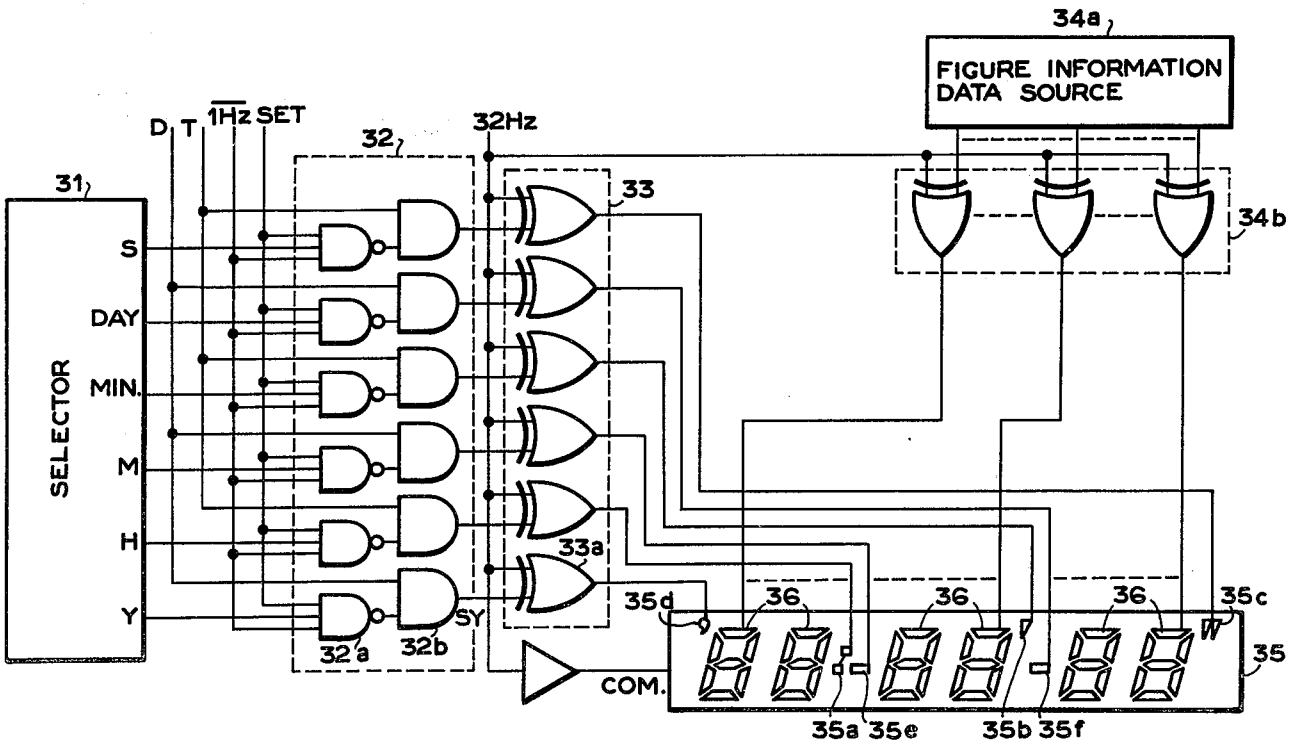
FIG. 4 is a circuit diagram showing an embodiment of a drive circuit for driving respective display portions according to the present invention.

One embodiment of a drive circuit for driving said display portions of this invention will be described hereinbelow with reference to FIG. 4.

In the drawing, reference numeral 31 designates a selector for selecting a unit to be corrected, 32 a selection gate circuit of partition segments showing the unit to be corrected by an output signal derived from said selector 31, and 33 a driver to convert each output signal from said partition segment selection gate circuit 32 into a display signal. Reference numeral **34*a* denotes a figure information data source for hour, minute and second, or year, month and date, by which figure information digit date to be displayed are provided. Further, reference numeral 34*b* represents a driver for converting the digit data from said figure information data source 34*a* into a display signal. Numeral 35 is a digit indicator comprising partition mark segments 35*a*, 35*b*, 35*c* for partitioning hour, minute and second informations; partiton mark segments 35*d*, 35*e*, 35*f* for partitioning year, month and date informations; and digits 36 to display figure information. Signal D which is applied to said selection gate circuit 32 represents a year, month and date display mode signal, signal T an hour, minute and second display mode signal, signal SET a correction condition signal, and signal $\overline{1HZ}$ a flashing cycle signal, respectively. Signal 32 Hz represents a drive cycle signal of segment display signal. This drive cycle signal 32 Hz is applied to a common segment electrode Com of the digit indicator 35 through a buffer. With this circuit as described above, when, for instance, "year" information is to be corrected, the "year" unit selection signal Y in the selector 31 is selected to be "1" in the binary logical value. In this case, as a matter of course, the year, month, date display mode signal D and the correction condition signal SET both become "1." Therefore, NAND gate 32*a* to which the "year" unit selection signal Y, correction signal SET and flashing cycle signal $\overline{1HZ}$ are applied, repeatedly provides "1" or "0" through said flashing signal $\overline{1HZ}$. This output of the NAND gate 32*a* and the output SY of AND gate 32*b* to which said calendar display mode signal D is applied and which is controlled by the output of said NAND gate 32*a*, function to flash the "year" unit partition segment 35*d* through a driver 33*a*. The other calendar information partition mark segments 35*e*, 35*f*** are kept lighted. While, in this case, the partition mark segments for the hour, minute, second information are not displayed since the hour, minute or second display mode signal T is "0." Therefore, the selection of correction unit by flashing a unit to be corrected as described above, facilitates reading of corrected value and prevents erroneous corrections.

As described hereinabove, the digit display timepiece according to the present invention has such an advantage that, when any of the clock information display portions of said timepiece is corrected, the corresponding partition mark in the clock information display portion is flashed, whereby the display portion to be corrected is clearly indicated and confirmation of the information figures in the correcting state can be easily made. Further, the "year" display portion is provided with an apostrophe indicator as described in the above embodiment. Therefore, when the "year" display portion is corrected, if the apostrophe indicator is flashed, the discrimination of the calendar information display from the time information display can be easily made and the "year" display portion can be easily discerned to be in a correction condition. Thus, the present invention has a great effect in a practical use.

What is claimed is:

1. A digit display timepiece comprising electronic optical display devices, a clock information indicator for displaying units of information, and partition marks provided near each respective unit in the clock information indicator, said partition marks corresponding to a particular unit, flashing when the clock information with regard to the particular unit is corrected.

2. The digit display timepiece as claimed in claim 1, in which said clock information indicator comprises a year display portion and said partition mark corresponding to said year display portion is an apostrophe segment.

3. The digit display timepiece as claimed in claim 2, in which said apostrophe segment is provided at a left shoulder portion of the year display portion.

4. The digit display timepiece as claimed in claim 1 wherein said partition mark is comprised of a colon.

5. The digit display timepiece as claimed in claim 1 wherein said partition mark is comprised of a hyphen.

6. The digit display timepiece as claimed in claim 1 wherein said partition mark is comprised of an apostrophe.

7. The digit display timepiece as claimed in claim 1 wherein said partition mark is comprised of a dash.

8. The digit display timepiece as claimed in claim 1 wherein said partition mark is comprised of two dashes.

9. The digit display timepiece as claimed in claim 4 wherein said clock information indicator comprises an hour display portion which corresponds to said colon.

10. The digit display timepiece as claimed in claim 5 wherein said clock information indicator comprises a month display portion corresponding to said hyphen.

11. The digit display timepiece as claimed in claim 5 wherein said clock information indicator comprises a date display portion corresponding to said hyphen.

12. The digit display timepiece as claimed in claim 7 wherein said clock information indicator comprises a minute display portion corresponding to said dash.

13. The digit display timepiece as claimed in claim 8 wherein said clock information indicator comprises a second display portion corresponding to said two dashes.

14. The digit display timepiece as claimed in claim 1 further comprising:

(a) a selector for selecting a unit to be corrected;

(b) a selection gate circuit of partition segments showing the units to be corrected by an output signal derived from said selector;

(c) a driver for converting each output signal from said partition segment selection gate circuit into a display signal;

(d) a figure information data source for supplying figure information digit data to be displayed by said electronic optical display devices; and (e) a driver for converting the digit data from said figure information data source into a display signal.

15. A digit display timepiece comprising electronic optical display devices, a clock information indicator for displaying units of information having at least a year display portion, and partition marks provided near each respective unit in the clock information indicator having at least an apostrophe segment at an upper left portion of said year display portion, said apostrophe segment corresponding to said year display portion and indicating a position of said year display portion.

16. The digit display timepiece as claimed in claim 15 wherein said clock information indicator comprises a month display portion and said partition mark corresponding to said month display portion is a hyphen for indicating a position of said month display portion.

17. The digit display timepiece as claimed in claim 15 wherein said clock information indicator comprises a date display portion and said partition mark corresponding to said date display portion is a hyphen indicating a position of said date display portion.

* * * * *